United States Patent [19]

Eskelinen et al.

[11] Patent Number: 4,953,297

[45] Date of Patent: Sep. 4, 1990

[54] METHOD OF AND DEVICE FOR POCKET VENTILATION IN THE DRYING SECTION OF A PAPER MACHINE, IN PARTICULAR FOR HIGH-SPEED PAPER MACHINES

[75] Inventors: Pekka Eskelinen; Pentti Raatikainen, both of Turku; Markku Karlsson, Parainen; Raimo Virta, Turku, all of Finland

[73] Assignee: Valmet Paper Machinery Inc., Finland

[21] Appl. No.: 295,607

[22] PCT Filed: May 13, 1987

[86] PCT No.: PCT/FI87/00065

§ 371 Date: Dec. 27, 1988

§ 102(e) Date: Dec. 27, 1988

[87] PCT Pub. No.: WO88/08898

PCT Pub. Date: Nov. 17, 1988

[51] Int. Cl.[5] ..... F26B 5/00

[52] U.S. Cl. ..... 34/23; 34/114; 34/116; 34/123

[58] Field of Search ..... 34/23, 114, 116, 123, 34/111, 122

[56] References Cited

U.S. PATENT DOCUMENTS

| | | | |
|---|---|---|---|
| 3,753,298 | 8/1973 | Ely | 34/117 |
| 4,539,762 | 9/1985 | Eskelinen et al. | 34/116 |
| 4,602,499 | 7/1986 | Eskelinen et al. | 34/23 |

FOREIGN PATENT DOCUMENTS

| | | |
|---|---|---|
| 68279 | 4/1985 | Finland . |
| 444589 | 4/1986 | Sweden . |
| 2153508 | 8/1985 | United Kingdom . |

*Primary Examiner*—Henry A. Bennet
*Assistant Examiner*—John Sollecito

[57] ABSTRACT

Method and device in multi-cylinder dryers of a paper machine, which the dryers comprise two lines of drying cylinders (10,11), in whose connection twin-wire draw is applied, by means of whose drying wire (F1,F2) a closed draw is obtained in the transfer of the paper web (W) from one cylinder line onto the other. In the closed draw, the guide rolls (12/13) of the drying wires (F1/F2) are placed at the proximity of the run of the other wire (F2/F1) on which the drying wire runs from its drying cylinder (11/10) to its guide roll (13/12). For the purpose of ventilation of the pockets (T1,T2) defined by the drying wires (F1,F2) and by the free faces of the drying cylinders (10,11), an air jet or air jets (S1) are blown against the drying wires (F1,F2) within the area in which the drying wire (F1/F2) contacts a portion of the web (W) supported by the other drying wire F2/F1 which runs over a segment of the circumference of the guide roll (13/12) of the other drying wire F2/F1. From the air jets, drying air is passed through a widening wedge space (N) defined by the said drying wire (F1/F2) and by the portion of the web (W) and the other drying wire F2/F1 which runs over a segment of the circumference of the guide roll (13/12) of the other drying wire F2/F1 into the said pocket (T2/T1) so as to ventilate the pocket. The air jet (S1) or jets are preferably directed perpendicularly to the face of the drying wire (F1/F2) that is opposite relative the web (W) at a location facing the guide roll (13/12) of the other drying wire (F2/F1).

12 Claims, 4 Drawing Sheets

FIG. A PRIOR ART

FIG. B PRIOR ART

METHOD OF AND DEVICE FOR POCKET VENTILATION IN THE DRYING SECTION OF A PAPER MACHINE, IN PARTICULAR FOR HIGH-SPEED PAPER MACHINES

The invention concerns a method in multi-cylinder dryers of a paper machine, which said dryers comprise two lines of drying cylinders, in whose connection twin-wire draw is applied so that, by means of the said drying wires, a closed draw is obtained in the transfer of the paper web from one cylinder line onto the other, and in which said method, in view of providing the said closed draw, the guide rolls of the drying wires are placed at the proximity of the run of the other wire on which the drying wire runs from its drying cylinder to its guide roll, whereat air is blown through the said drying wires so as to ventilate the pockets defined by the said wires and the free faces of the drying cylinders.

The invention further concerns a device intended for carrying out said method in a multi-cylinder dryer of a paper machine, which said dryer comprises two lines of drying cylinders placed one above the other, in which said dryer twin-wire draw is applied so that the drying section comprises an upper wire, which is guided by its guide rolls, and a corresponding lower wire, which is guided by its guide rolls, and which said guide rolls are placed so that the web runs from the upper cylinders onto the lower cylinders and vice versa all the time supported by the drying wires and in which said device, in said gaps between the cylinders, the web is transferred from one drying wire onto the other at the guide roll of the latter drying wire.

In recent years the running speeds of paper machines have been increasing constantly, and now the limit of 1500 meters per minute is already approaching. Thereat, fluttering of the web becomes a serious problem deteriorating the running quality of the power machine. The passing of the web from the press section into the drying section and the supporting of the web within the area of single-wire draw can be controlled by means of the methods and devices suggested in the applicant's certain earlier Finnish patents and Finnish patent applications, but within an area of twin-wire draw, in particular in the 3rd and 4th drive groups, difficulties have been encountered at high running speeds.

In the present application, single-wire draw means such a mode of passing of the web over the heated drying cylinders in which the web passes from one cylinder line to the other supported by the drying wire so that on one cylinder line the web is between the drying wire and the cylinder face, and on the other cylinder line the web is outside and the drying wire is between the cylinder face and the web, and the web runs the passages between the cylinder lines supported by the drying wire. It is an advantage of this single-wire draw that the web is all the time supported by the drying wire and it has no open draws, or at least no substantially long open draws, whereby the risk of wrinkles and breaks of the web is lowered.

In the present application, twin-wire draw means the prior-art mode of supporting and passing the web in connection with the heated drying cylinders in which an upper wire is used on the upper cylinders and, correspondingly, a lower wire on the lower cylinders, which said wires are guided by the faces of the drying cylinders and by guide rolls placed between the drying cylinders so that, on the line of upper cylinders, the web is pressed by the upper wire into direct drying contact against the faces of the upper cylinders and, correspondingly, the web is pressed by the lower wire onto the faces of the lower cylinders.

in the case of twin-wire draw, the web has usually had substantially long free runs when running from one cylinder line onto the other. These free runs have been subject to fluttering and to resulting breaks and wrinkles of the web, which drawback has become worse with increased running speeds of paper machines, and the drawback has appeared with particular emphasis in the initial part of the drying section, where the web is still relatively moist and, therefore, weak and where its elastic properties are favourable for fluttering. Attempts have been made to eliminate this drawback by shortening the said free runs of the web in the initial part of the drying section by placing the planes imagined as passing through the axes of the upper and lower cylinder lines at a shorter distance from each other than what is usually customary or what would be optimal, e.g., in view of efficiency of drying.

Conversion of the 3rd and 4th drying groups to single-wire draw has been used, but it is an emergency solution, because it results in reduced evaporating capacity and makes the arrangement of air-conditioning more difficult.

Attempts have been made to solve the problems in the running quality of the drying section, resulting from the increased running speeds of paper machines, by adopting the single-wire draw. Since this deteriorates the drying capacity of the machine, this mode should not be used anywhere else except where it is necessary, i.e. in the first and second drying groups. In the other groups of the drying section, attempts are made to get along with twin-wire draw, which is preferable in view of the drying capacity.

In prior art, for the solution of the above problems, suggestions are known in which the geometry of a machine provided with twin-wire draw has been converted so that the web runs all the time supported by a wire without free runs. Such drying sections are described, e.g., in the U.S. Pat. Nos. 3,751,822 3,753,298, and 4,510,698.

When the running speed of a paper machine becomes higher than 1000 m/min, the air flows produced by the wires become decisive in view of the running quality, and unless these air flows are controlled, the result is fluttering of the web, wrinkles, uneven drying, and even web breaks, with costly standstills resulting from them.

The applicant's earlier FI Patent Applications Nos. 841167 (Announcement publication No. 68,279), 850611, and 853670 are concerned with methods and devices by whose means the running quality of a machine provided with twin-wire draw can be improved.

The main object of the present invention is to improve the ventilation of the pockets in the drying section of a paper machine provided with twin-wire draw so that the running of the web and its contacts with the various drying wires are not disturbed. In view of achieving these objectives and those that will come out later, the method is mainly characterized in that an air jet or air jets are used as the said ventilation blows, which said jets are directed at the run of the drying wire at which the drying wire runs from its drying cylinder onto its guide roll, that the said air jets are applied within the said run of the drying wire in the area in which the drying wire contacts a portion of the web supported by the other drying wire which runs over a segment of the circumference of the guide roll of the other drying wire and in which said blow area there is a widening wedge space defined by the drying wire and its guide roll, through which said wedge space the pocket-ventilation blowing takes place.

On the other hand, the device in accordance with the invention is mainly characterized in that facing the guide rolls of the drying wires, against the substantially straight runs of the drying wire running from their drying cylinder as a substantially straight run to their guide roll, a blow box is fitted, which is connected to an air source, that the side of the said blow box that is placed facing the drying wire is provided with a nozzle slot or slots which are directed in such a way that out of them the air jet or jets are directed substantially perpendicularly to the drying wire placed facing them.

In the following, the invention and the prior art related to it will be described in detail with reference to the figures in the accompanying drawing.

FIG. A shows a part of a paper machine drying group provided with a prior-art conventional twin-wire draw.

FIG. B shows a part of a prior-art paper machine drying group provided with a twin-wire draw of modified geometry.

Figure 1:
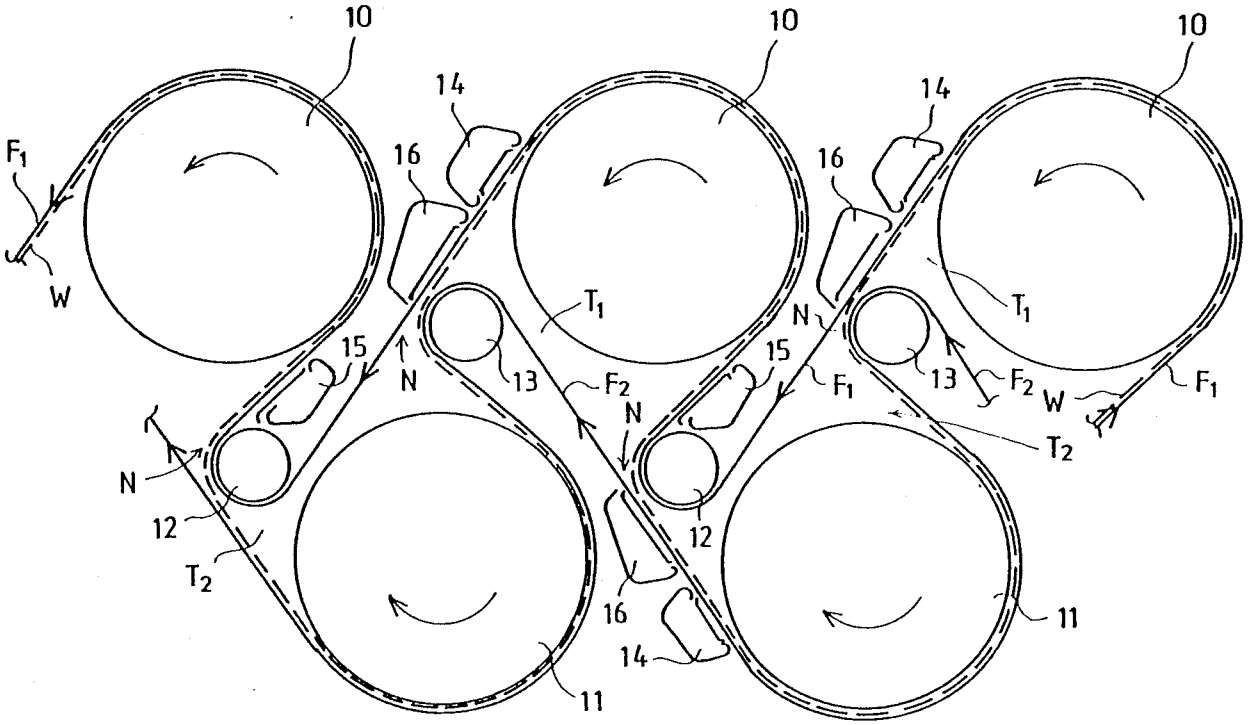
FIG. 1 shows the same as FIG. B, but added with pocket ventilation arrangements carrying out the method of the present invention and with devices improving the running quality.

In the twin-wire draw of the web W to be dried shown in FIG. A, which is in itself known, the web W is on the lower drying cylinders 11 between the lower wire F2 and the heated cylinder face 11'. This is why, in the twin-wire draw, the contact between the cylinders 10,11 and the web W is good, because of which the evaporation out of the web W and the drying of the web are efficient. In the prior-art twin-wire draw of FIG. A, the web W remains on its long run Wp between the upper cylinder 10 and the lower cylinder 11 unsupported by the wire, because the upper wire F1 runs over the upper wire guide rolls 12 and the lower wire F2 again over the lower wire guide rolls 13. The long unsupported runs Wp of the web W cause problems when the speed of the machine becomes high, especially owing to fluttering of the run Wp.

In the prior-art twin-wire draw of modified geometry shown in FIG. B, the wire guide rolls 12 and 13 have been shifted relative FIG. A so that the guide roll 12 of the lower wire F2 is placed higher than the guide roll 12 of the upper wire F1. In FIG. B, the web W runs all the way supported by the wires F1 and F2. However, at high running speeds of the machine, the air pumping induced by the wires F1 and F2 causes so strong air flows and so high differences in pressure at opposite sides of the web W that the web W does not remain in contact on the wires F1 and F2. In the pockets T1 and T2, the air humidity becomes high, which reduces the evaporation and results in uneven drying of the web W in its transverse direction.

Attempts have been made to improve the running quality of the modified geometry shown in FIG. B by converting the felt guide rolls to suction-blow rolls. This high-cost solution may improve the detaching of the web W from the guide roll at an appropriate point, but it does not reduce the air flows produced by the pumping by the wires F1 and F2, so that the problems of running quality cannot be solved on this route.

Figure 2:
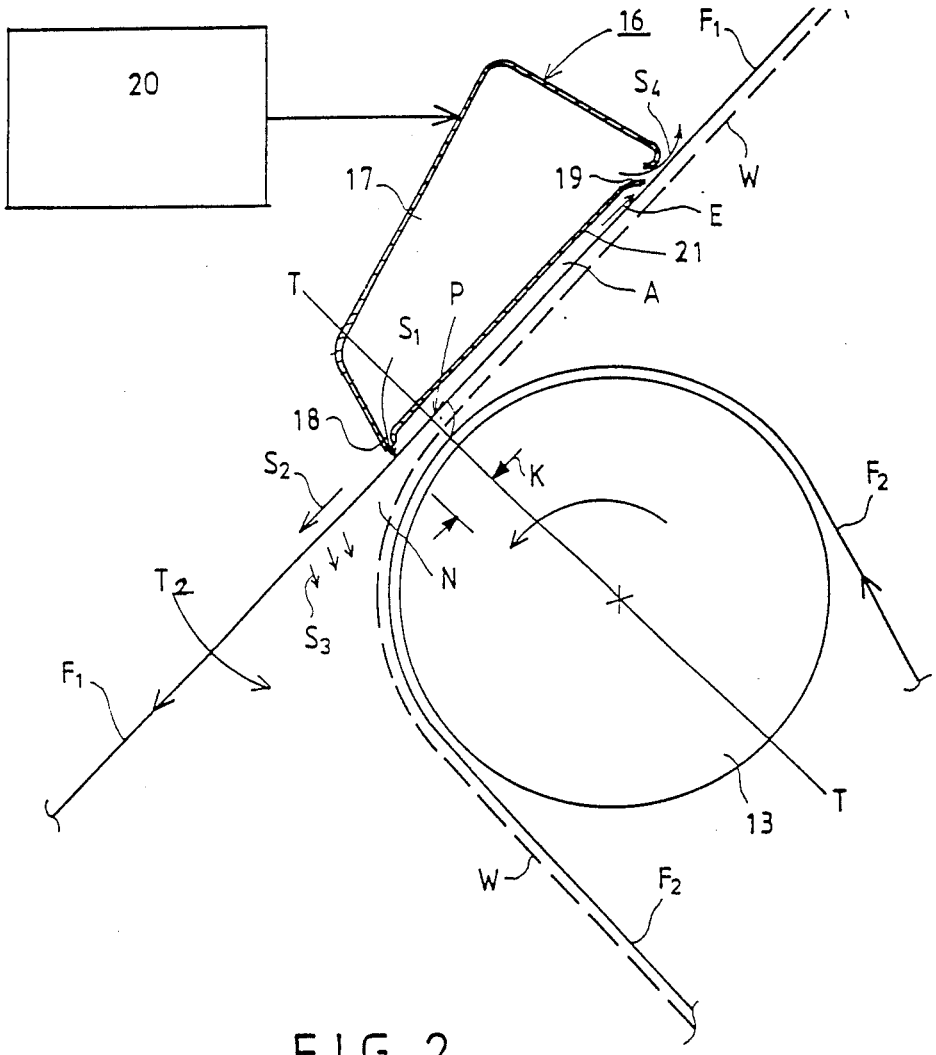
FIG. 2 shows a device carrying out the method of the invention on an enlarged scale.
Figure 3:
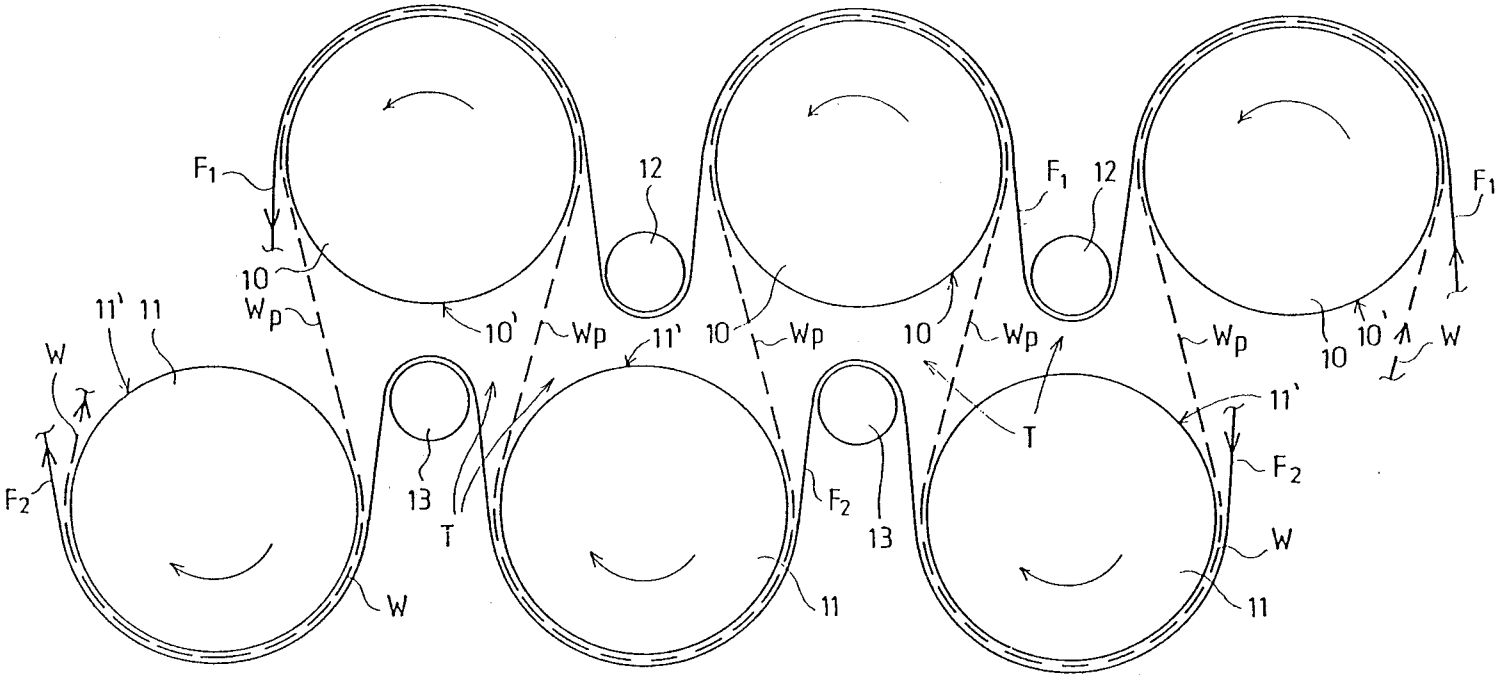
Figure 4:
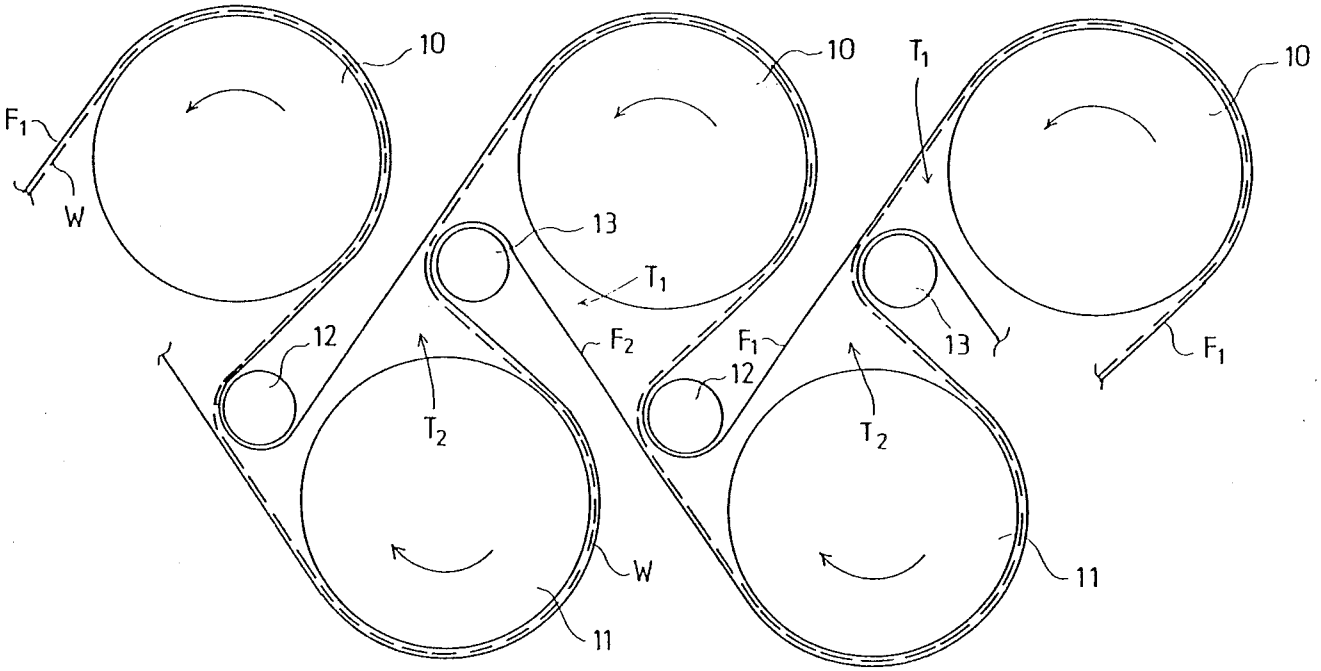

In the following, the invention will be described in detail with reference to FIGS. 1 and 2, which illustrate an inventive solution whose starting point is a cylinder dryer in accordance with FIG. B provided with a closed twin-wire draw. In FIGS. 1 and 2, the same reference denotations are used for the parts shown in FIG. A and B, so that the descriptions of FIGS. A and B will not be repeated in the following in these respects.

In FIG. 1, the equipment arrangements of the method of the present invention have been added to the twin-wire draw of modified geometry, which said arrangements are needed in particular when the speed of a paper machine becomes high (as a rule, speed > 1000 m/min). The devices 14 and 15 in accordance with the applicant's earlier FI Patent Application Nos. 850611 and 853670 stabilize the running of the web W by retaining the support contact between the web W and the wire F1 and F2. The pocket ventilation arrangement 16 in accordance with the present invention produces ventilation of the pockets T1 and T2, which lowers the level of air humidity in the pockets T1 and T2, increases the evaporation out of the web W, and produces a controlled drying process.

The pocket ventilation arrangement 16 in accordance with the invention is placed near the point at which the upper wire F1 and the guide roll 13 of the lower wire as well as the lower wire F2 and the guide roll 12 of the upper wire, respectively, are placed close to each other and reach contact with each other (while the web W and one of the wires F1/F2 are in between).

The operation of the pocket ventilation method in accordance with the invention comes out best from FIG. 2. The equipment arrangement applying the invention consists of blow boxes 17 extending over the entire width of the wires F1 and F2 in the direction transverse to the direction of running of the paper web W, which said boxes are connected to members that produce blow air, which said members are denoted schematically with block 20. At the box side facing the wire F1, at the trailing edge of the box 17, seen in the direction of running of the wire, there is a nozzle slot 18, through which an air jet S1 is blown perpendicularly or substantially perpendicularly against the wire F1. When the air jet S1 meets the wire F1 moving at a high speed, the jet is turned and becomes a jet S2 parallel to the wire F1, and part of the air passes through the permeable wire F1 so as to ventilate the pocket T2, which is illustrated by the arrows S3.

In FIG. 2, T-T denotes the plane that passes through the centre axis of the guide roll 13 and the tangent line P of the guide roll 13 and the wire F1. After this line a nip N (wedge space) widening in the direction of running of the wires F1 and F2 and of the web starts, and air is transferred within the area of the said nip N by means of the blowing in accordance with the invention through the nozzle slot 18 so as to ventilate the pocket T2 (arrows S3). As is seen from the figure, the nozzle slot 18 is placed at the proximity of the wire F1 a certain little distance k after the said tangent line P.

The quantity of air (S3) that passes through the wire F1, which is about 25 to 30 per cent of the entire quantity of blow air passed out of the box 17, is well sufficient for the ventilation of the pocket T2. The air is removed out of the pocket T2 to the sides of the machine. The air flow S3 passing through the wire F1 also helps in detaching the web W from the wire F1 at the correct point and in the transfer of the web to the support on the other wire F2, which improves the running quality.

If necessary, a blow nozzle 19 known from the applicant's earlier FI Patent Application No. 850611 may be placed at the leading edge of the blow box 17, whereby the air jet S4 discharged from the said nozzle 19, by its ejection effect (arrow E), improves the support contact between the web W and the wire F1 as it produces a negative pressure in the space A between the box 17 wall 21 and the wire F1. The use of a nozzle 19 does, however, not have any effect—at least not a detrimental effect—on the operation of the pocket ventilation arrangement 16 carrying out the method of the present invention.

At the sides of the wire F1, the blow box 17 extends to the proximity of the edges of the wire F1, and at the ends of the blow box 17 it is possible to use edge nozzles similar to the nozzle 19 in order to prevent leakage flow from the sides of the machine into areas with negative pressure.

In relation to FIG. 2, a detailed description has been given of the stage of the method of the invention in which the web W is transferred as a closed draw from the upper wire F1 of the multi-cylinder dryer onto the lower wire F2. It can be understood directly that the corresponding method steps are performed and the same equipment arrangements are used when the web W is transferred as a closed draw from the lower wire F2 onto the upper wire F1 in connection with the guide rolls 12 of the latter wire. The description of FIG. 2 is applicable in respect of these method steps and equipment solutions as such when the upper wire F1 is substituted for by the lower wire, the guide roll 13 by the roll 12, and the pocket T2 by the other pocket T1.

When the method of the invention is applied, the permeability of the transfer wires F1 and F2 is, as a rule, within the range of 2000 to 7000 $m^3/hxm^2$, preferably within the range of 3000 to 5000 $m^3/hxm^2$.

The speed of the air jet S1 blown out of the nozzle slot 18 or out of corresponding several nozzle slots is, as a rule, within the range of v=10 to 50 m/s, preferably v=about 30 m/s.

With the above parameters and with purposeful alignment of the air jet S1 or jets, an air flow (S3) can be applied through the drying wires to the pockets T1 and T2 whose flow quantities are, as a rule, within the range of 100 to 400 $m^3/hxm$, preferably within the range of 150 to 250 $m^3/hxm$.

In the following, the patent claims will be given, whereat the different details of the invention may show variation within the scope of the inventive idea defined in the said claims and differ from the details described above for the sake of example only.

What is claimed is:

1. Method of operating multi-cylinder dryers of a paper machine, where said dryers comprise two lines of drying cylinders (10, 11), in whose connection a twin-wire draw is applied so that, by means of a first and second drying wire (F1, F2), a closed draw is obtained in the transfer of a paper web (W) from one cylinder line onto another, and in which method, a closed draw is provided, guide rolls (12/13) of the respective first and second drying wires (F1/F2) are placed at the proximity of the run of the other wire (F2/F1) on which the drying wire runs from its drying cylinder (11/10) to its guide roll (13/12) whereat air is blown through said drying wires (F1/F2) so as to ventilate pockets (T1/T2) defined by said wires and free faces of the drying cylinders (10/11), characterized in that an air jet or air jets (S1) are used as ventilation blows, said jets being directed at the run of the first and second drying wires (F1/F2) at which the respective drying wire (F1/F2) runs from its drying cylinder (11/10) onto its guide roll (13/12), that said air jets are applied within said run of the drying wire (F1/F2) in the area in which the respective drying wire (F1/F2) contacts a portion of the web (W) supported by the other respective drying wire (F2/F1) which runs over a segment of the circumference of the guide roll of the other respective drying wire (F2/F1) and in which blow area there is a widening wedge space (N) defined by the respective drying wire (F1/F2) and its guide roll (13/12), through which wedge space the pocket ventilation blowing takes place.

2. Method as claimed in claim 1, characterized in that said air jet (S1) or jets are directed substantially perpendicularly to a face of said drying wire (F1/F2) that is opposite a location facing the guide roll (13/12) of the drying wire (F2/F1).

3. Method as claimed in claim 1, characterized in that said air jet (S1) or jets are applied outside the drying wire (F1/F2) to a location placed a certain distance (k) after a normal plane (T-T) of the first mentioned drying wire (F1/F2) said normal plane passing through the centre axis of the guide roll (13/12) of the other drying wire (F2/F1), said guide roll (13/12) being placed facing said first-mentioned drying wire (F1/F2).

4. Method as claimed in claim 1, characterized in that besides providing ventilation of said pockets (T1, T2), said air jet (S1) or jets also promote detaching of the web (W) from the wire (F1/F2) to which air jet (S1) is applied and transfer of the web (W) onto the other drying wire (F2/F1).

5. Method as claims in claim 1, characterized in that before air jet (S1) or jets, a second air jet (S4) or air jets are applied by means of which the second air jet is ejected (F) out of an area (A) placed before the first-mentioned air jet (S1) and defined by a wall (21) of a blow box adjacent to the drying wire in which a negative pressure is formed in the area (A), by means of which negative pressure, the keeping of the web (W) on the face of the drying wire is promoted.

6. Method as claimed in claim 1, characterized in that permeability of the drying wires (F1,F2) used in the method is within the range of 2000 to 7000 $m^3/hxm^2$, preferably within the range of 3000 to 5000 $m^3/hxm^2$.

7. Method as claimed in claim 1, characterized in that said blowings are applied to the face of the drying wire (F1) through a nozzle slot (18) or slots in the blow box (17) such that the velocity of the air jet (S1) or jets in the blowing is within a range of v=10 to 50 m/s, preferably v=30 m/s.

8. Method as claimed in claim 1, characterized in that the air quantity, velocity and alignment of the air jet (S1) are arranged in such a way that air flow (S3) applied through said drying wires (F1, F2) into the respective pockets (T1, T2) is within a range of 100 to 400 $m^3/hxm$, preferably within a range of 100–250 $m^3/hxm$.

9. Method as claimed in claim 1, characterized in that in connection with the respective drying wire or wires (F1,F2), blow devices (14 and/or 15) are provided, by means of air jets applied substantially parallel to the plane of the drying wire at the opposite side of the drying wire relative the web (W) facing it so that, by means of said air jets, air is ejected so that an area of negative pressure is produced by means of which the keeping of the web (W) in conformity with the face of the drying wire (F1, F2) facing the web is promoted.

10. A multi-cylinder dryer for a paper machine, said dryer comprising two lines of drying cylinders (10,11) placed one above the other in which a twin-wire draw is applied so that a drying section comprises an upper wire (F1), which is guided by guide rolls (12), and a corresponding lower wire (F2), which is guided by guide rolls (13), said guide rolls being placed so that a web (W) runs from upper cylinders (10) onto lower cylinders (11) and vice versa at all times supported by drying wires (F1, F2) and in said dryer, in gaps formed between the cylinders, the web (W) is transferred from one drying wire (F1/F2) on to the other (F2/F1) at the respective guide roll (13/12) of the latter drying wire (F2/F1), characterized in that facing the guide rolls (12, 13) of the drying wires, (F1,F2), against substantially straight runs of the drying wire (F1,F2) running from their respective drying cylinder (10,11) as a substantially straight run to their respective guide roll (12,13), a blow box (17) is fitted, which is connected to an air source (20), a side of said blow box (17) is placed facing the drying wire (F1,F2) and is provided with a nozzle slot (18) or slots which are directed in such a way that air jet (S1) or jets are directed substantially perpendicularly to the respective facing drying wire (F1,F2).

11. Dryer as claimed in claim 10, characterized in that said blow box (17) and its nozzle slot (18) or corresponding slots are placed in such a way that the air jet (S1) or jets applied meet the drying wire (F1,F2) after a tangent point (P) with the guide roll (12,13) of the other drying wire.

12. Dryer is claimed in claim 10, characterized in that at an opposite edge of the blow box, relative to said nozzle slot (18) or slots, there is a nozzle slot (19) from which an air jet (S4) is applied, said air jet (S4) air can be ejected out of space (A) defined by a wall (21) of said blow box (17) placed facing the drying wire (F1, F2).

* * * * *